US011349258B2

(12) United States Patent
Lin et al.

(10) Patent No.: US 11,349,258 B2
(45) Date of Patent: May 31, 2022

(54) SELF-LOCKING PLUG

(71) Applicant: BEIJING TOP ELECTRIC CO., LTD., Beijing (CN)

(72) Inventors: Haiqing Lin, Beijing (CN); Qiang Yu, Beijing (CN); Yue Zhang, Beijing (CN)

(73) Assignee: BEIJING TOP ELECTRIC CO., LTD., Beijing (CN)

( * ) Notice: Subject to any disclaimer, the term of this patent is extended or adjusted under 35 U.S.C. 154(b) by 0 days.

(21) Appl. No.: 16/920,447

(22) Filed: Jul. 3, 2020

(65) Prior Publication Data

US 2020/0335910 A1 Oct. 22, 2020

Related U.S. Application Data

(63) Continuation of application No. PCT/CN2018/105344, filed on Sep. 13, 2018.

(30) Foreign Application Priority Data

Jul. 17, 2018 (CN) ..... 201810786742.X

(51) Int. Cl.
*H01R 13/631* (2006.01)
*H01R 13/639* (2006.01)
*H01R 13/633* (2006.01)

(52) U.S. Cl.
CPC ..... *H01R 13/639* (2013.01); *H01R 13/631* (2013.01); *H01R 13/6335* (2013.01)

(58) Field of Classification Search
CPC ..... H01R 13/639; H01R 13/631; H01R 13/6335; H01R 24/22; H01R 13/6275; H01R 13/6392
See application file for complete search history.

(56) References Cited

U.S. PATENT DOCUMENTS 6,364,675 B1 * 4/2002 Brauer ..... H01R 13/635 439/348
8,968,021 B1 * 3/2015 Kennedy ..... H01R 13/6273 439/352
2013/0109213 A1 * 5/2013 Chang ..... H01R 13/6395 439/304
2014/0199867 A1 * 7/2014 Rogers ..... H01R 31/06 439/173

(Continued)

FOREIGN PATENT DOCUMENTS

CN 202949090 5/2013
CN 104283057 1/2015

(Continued)

*Primary Examiner* — Truc T Nguyen
(74) *Attorney, Agent, or Firm* — JCIP Global Inc.

(57) ABSTRACT

A self-locking plug includes a main body, a plug bush seat arranged in the main body for positioning a plug bush, at least one locking tab, and a linkage. The self-locking plug further includes a key mechanism arranged in the main body. The key mechanism includes a pressing portion and a driving portion which are respectively arranged at two ends of the key mechanism. The driving portion is associated with one end of the linkage, and is configured to drive the linkage to reciprocate in an axial direction of the main body to switch the locking tab between a releasing state and a locking state.

10 Claims, 6 Drawing Sheets

(56) References Cited

U.S. PATENT DOCUMENTS

| | | | | |
|---|---|---|---|---|
| 2015/0270644 | A1* | 9/2015 | Marsh | H01R 13/639<br>439/347 |
| 2017/0214168 | A1* | 7/2017 | Schroll | H01R 13/6272 |
| 2018/0040976 | A1* | 2/2018 | Matsumoto | H01R 13/6275 |
| 2018/0159273 | A1 | 6/2018 | Toh et al. | |

FOREIGN PATENT DOCUMENTS

| | | |
|---|---|---|
| GB | 2383202 | 5/2005 |
| WO | 2013171440 | 11/2013 |
| WO | 2016170298 | 10/2016 |

* cited by examiner

SELF-LOCKING PLUG

CROSS-REFERENCE TO RELATED APPLICATION

This application is a continuation of international application of PCT application serial no. PCT/CN2018/105344 filed on Sep. 13, 2018, which claims the priority benefit of China application no. 201810786742.X filed on Jul. 17, 2018. The entirety of each of the above mentioned patent applications is hereby incorporated by reference herein and made a part of this specification.

BACKGROUND

Technical Field

The present application relates to the technical field of electrical devices, and in particular, to a self-locking plug.

Description of Related Art

Some prior art connectors have been designed to reduce the ease with which the connector, whether in the form of a plug or socket, may be removed from or may inadvertently fall out from a mating socket or plug.

SUMMARY

To overcome the shortcomings of the prior art, it is an object of the present application to provide a self-locking plug, which conforms to operating habits of users and effectively reduces abrasion of the locking tab to the plug.

The present application is achieved by the following technical solutions.

A self-locking plug includes a main body, a plug terminal contact seat arranged in the main body for positioning a plug terminal contact, at least one locking tab, and a linkage. The self-locking plug further includes a key mechanism arranged in the main body. The key mechanism includes a pressing portion and a driving portion which are respectively arranged at two ends of the key mechanism, the driving portion is associated with one end of the linkage, and is configured to drive the linkage to reciprocate in an axial direction of the main body to switch the locking tab between a releasing state and a locking state.

The key mechanism is two in number. The two key mechanisms are arranged symmetrically. The linkage is in drive-connection with the two key mechanisms simultaneously.

A sliding groove is arranged on the linkage, a driving pin is correspondingly arranged on the driving portion, or a driving pin is correspondingly arranged on the linkage, and a sliding groove is correspondingly arranged on the driving portion.

The driving pin is an ejector pin arranged on both sides of a tail end of the linkage, a tail end face of the ejector pin is formed with an arc chamfer, and the sliding groove is a rectangular groove.

The main body includes a bottom shell and an upper cover that are fixedly connected with each other, the bottom shell includes a bottom plate, a head cavity integrally arranged at a front end of the bottom plate and a cable exiting groove integrally arranged at a tail end of the bottom plate, a front end of the plug terminal contact seat extends into the head cavity, and a rear end of the plug terminal contact seat is limited by a positioning boss arranged on the bottom plate.

A guide groove is formed at a bottom portion of the plug terminal contact seat and is configured to position and guide the linkage, a spring positioning boss is arranged in the guide groove, and a spring-embedded groove with an opening at a rear end is arranged on the linkage for positioning a return spring.

The key mechanism is of a groove-type structure with side portions of the main body fitted therein, the sliding groove or the driving pin is correspondingly arranged on an inner sidewall of the driving portion, and escape recesses are arranged on the main body corresponding to the driving portion and a linkage portion.

A recessed groove with an opening at a tail end thereof is formed at a tail portion of the bottom plate, and a tail end of the linkage extends out of the main body and is fitted in the groove.

A raised guide portion mated with the recessed groove is formed on the linkage, and the guide portion is flush with or is lower than a bottom surface of the bottom plate.

At least an end portion of the recessed groove is a T-shaped groove, and the linkage is formed with a guide fin corresponding to the T-shaped groove.

Advantages and beneficial effects of the present application are as follow.

Through the self-locking plug of the present application, pressing on the key mechanism is converted to driving on the locking tab through the linkage, and the key mechanism itself is of a lever-type structure, the action of rotation around the shaft when a force is applied on the pressing portion thereof results in a plugging or unplugging action of the self-locking plug. Actions of pinching and plugging the plug perform coherently, which conforms to operating habits of users, prevents from scratching the plug to a large extent, and improves safety in use and service life, besides, the key mechanism has a small range of action and little interference with the surrounding parts, thereby is applicable for any compact operation space.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
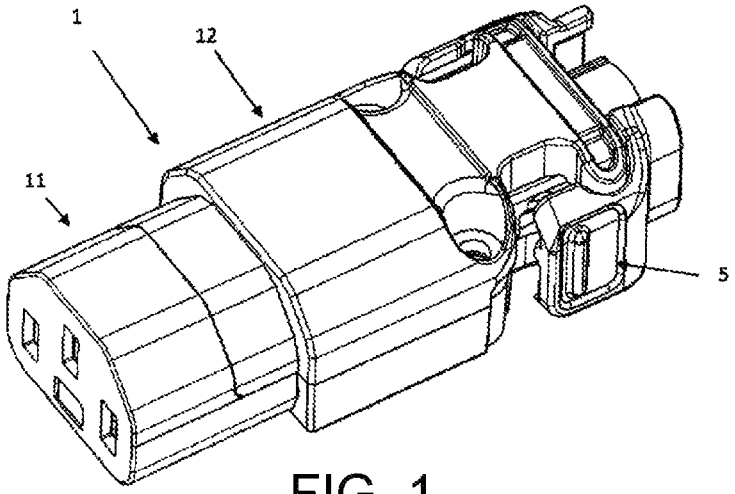
FIG. 1 is an isometric schematic view of a self-locking plug according to the present application.
Figure 2:
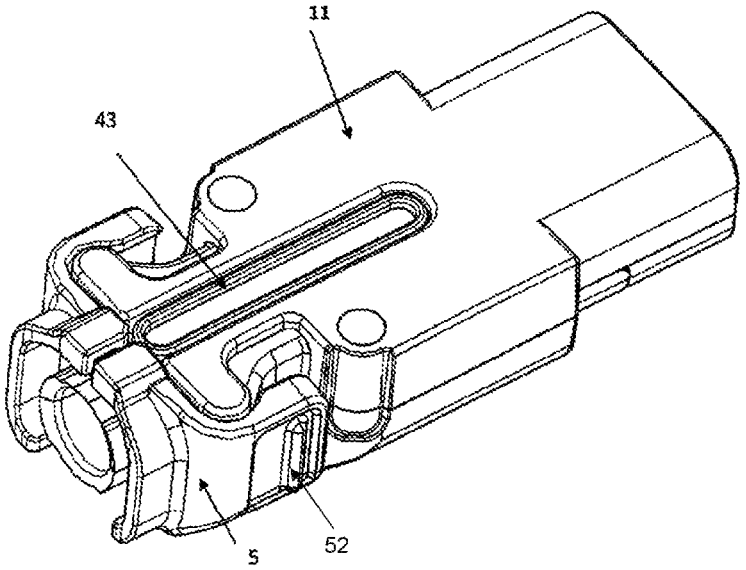
FIG. 2 is a schematic view from another perspective of the self-locking plug according to the present application.
Figure 3:
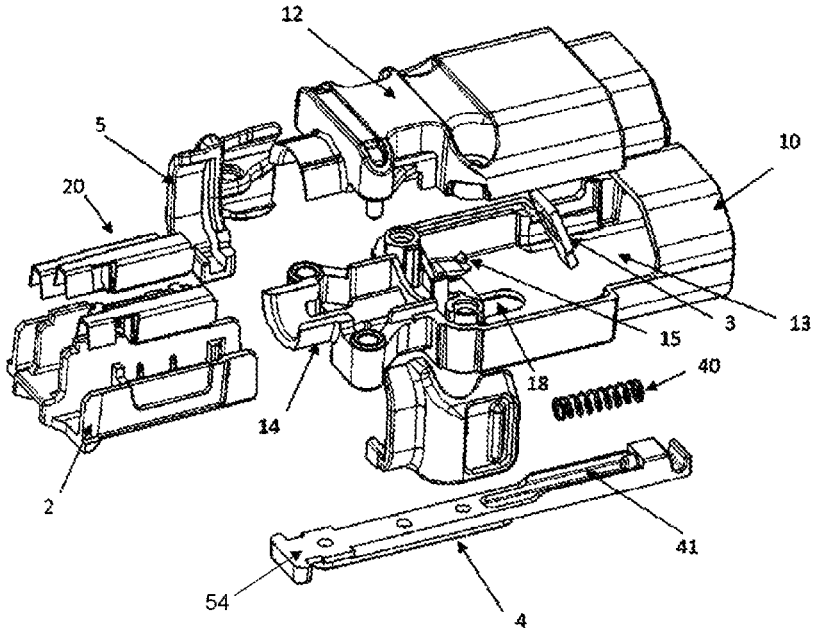
FIG. 3 is an exploded structural view of the self-locking plug according to the present application.
Figure 4:
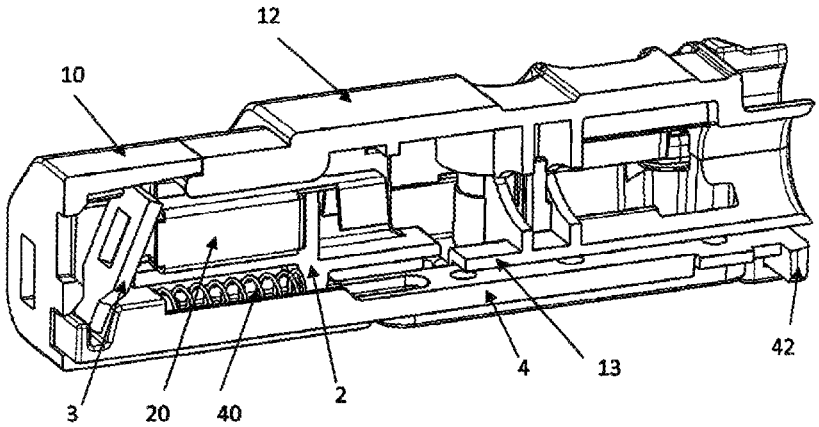
FIG. 4 is a sectional structural view of the self-locking plug according to the present application.
Figure 5:
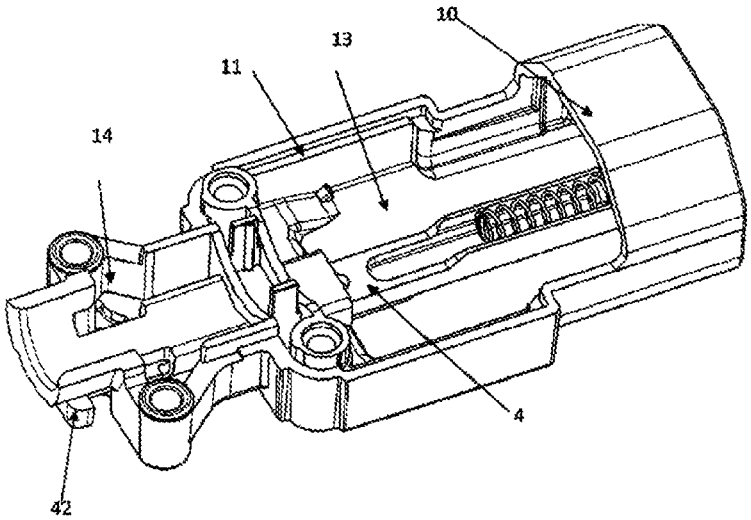
FIG. 5 is a schematic structural view of a bottom shell equipped with a linkage.
Figure 6:
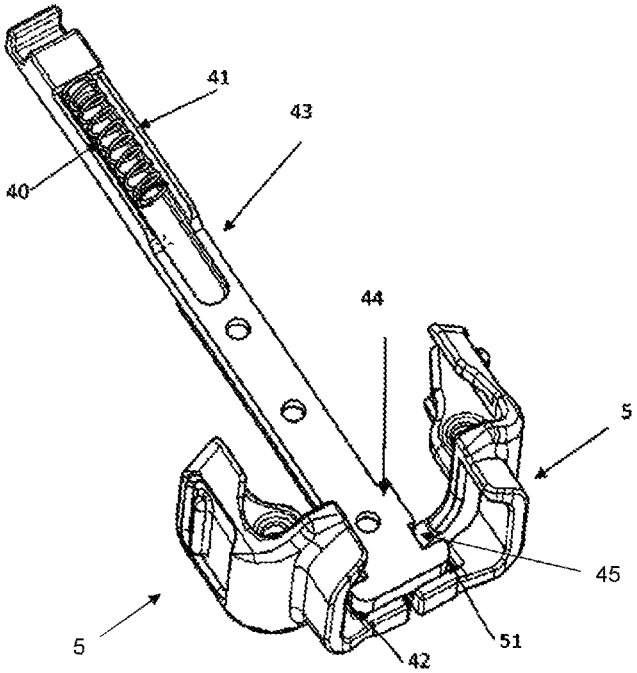
FIG. 6 is a schematic view showing fitting relationship between the linkage and a key mechanism.
Figure 7:
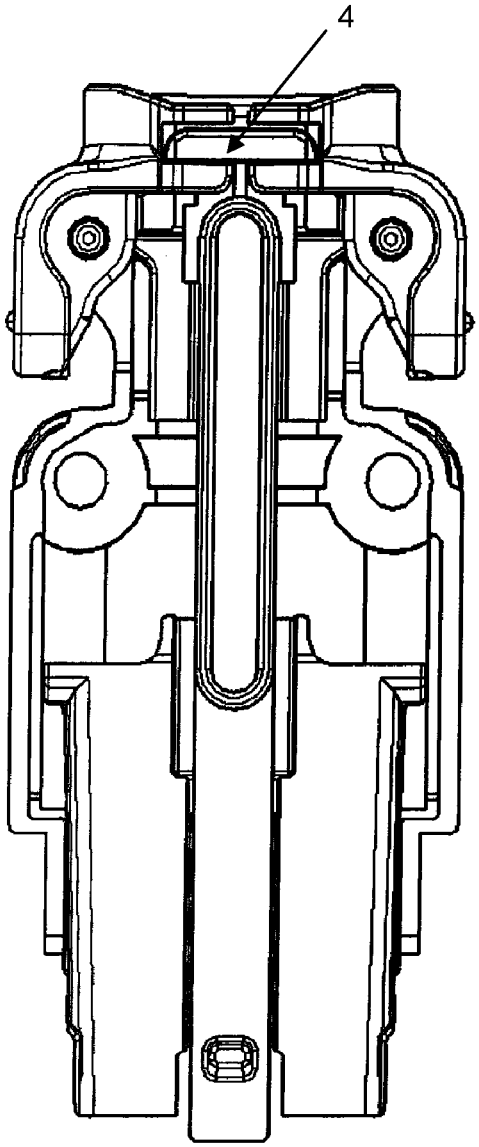
FIG. 7 is a schematic structural view of the self-locking plug in a free state.
Figure 8:
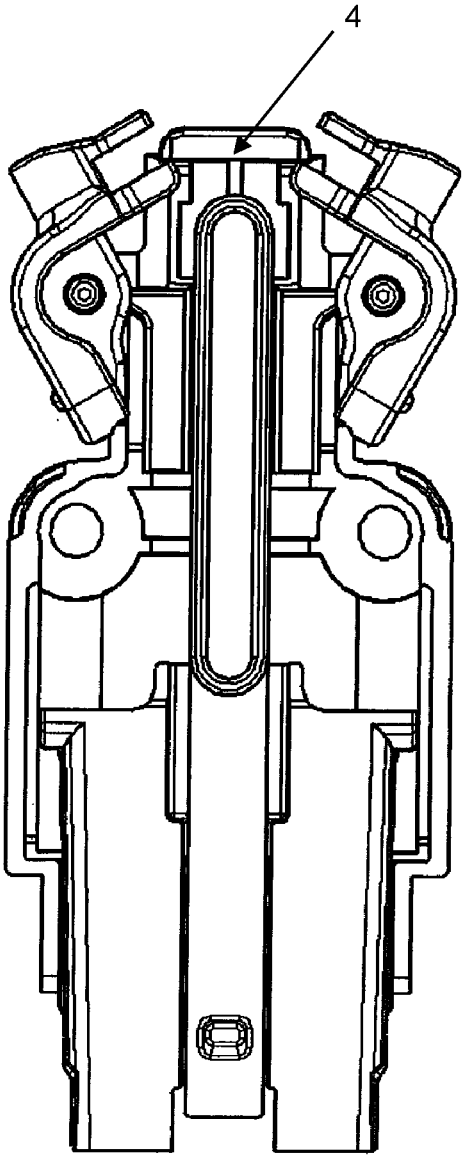
FIG. 8 is a schematic structural view of a locking tab in a releasing state during insertion.
Figure 9:
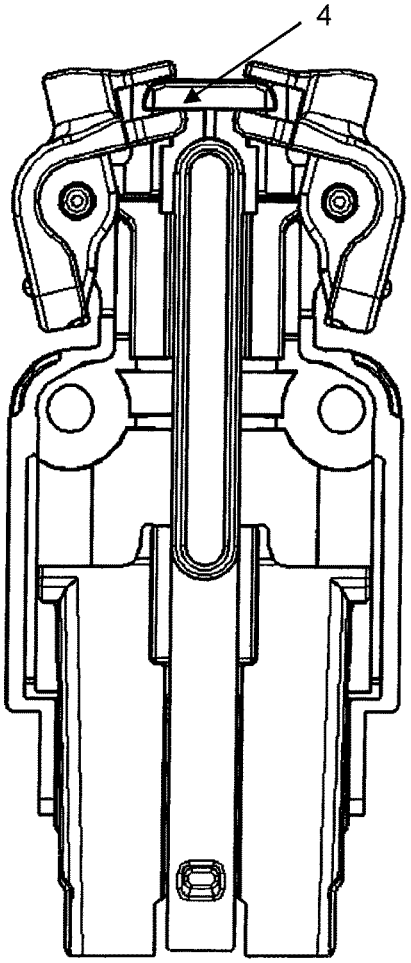
FIG. 9 is a schematic structural view of the locking tab in a locking state.
Figure 10:
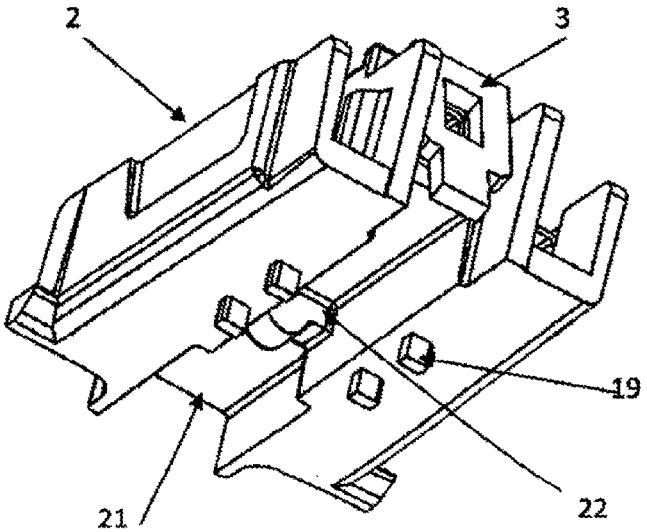
FIG. 10 is a schematic structural view of a plug terminal contact seat.
Figure 11:
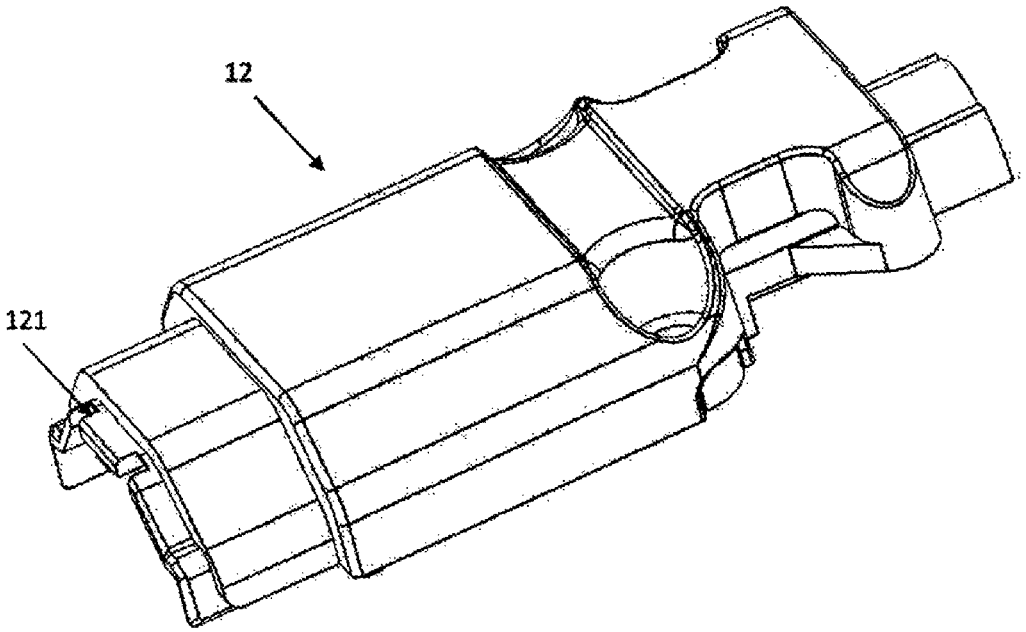
FIG. 11 is a schematic structural view of an upper cover.
Figure 12:
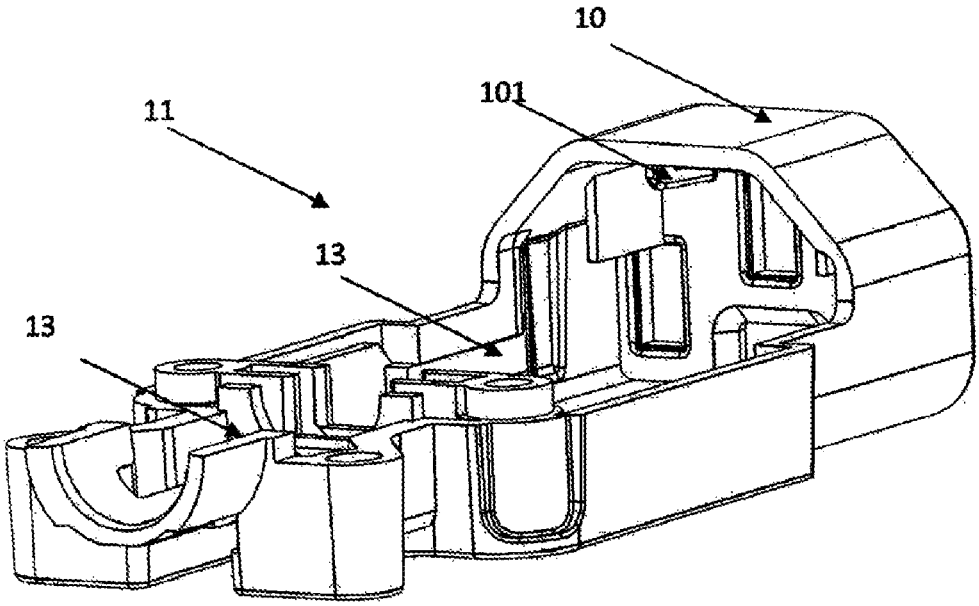
FIG. 12 is a schematic structural view of the bottom shell.

In order to make those skilled in the art better understand the technical solutions of the present application, the technical solutions of the present application will be further described hereinafter with reference to FIG. 1 to FIG. 12 and specific embodiments.

A known solution, used commonly in computer equipment, is for screws or clips to be provided at either side of the connector to retain the connector attached to the equipment. However, screwing or clipping the connector to the equipment is laborious and in many cases is rendered difficult by space limitations.

To address this problem, it is known for a connector to be provided with a locking mechanism which a user needs to operate in order to separate the connector from a mating connector component. An example of a well-known and successful locking connector is that described in the UK patent GB 2383202.

However, particularly in respect of computers and similar electrical equipment, the continuing drive for compactness of construction has resulted in a substantial reduction in the space envelope that conventionally has surrounded a removable connector.

Thus, for example, recently introduced types of PCU connectors feature in proximity to the connector position additional metallic tabs or handles are used for easy removal from a server back. Due to the compactness of equipment design, the release tab provided on many types of lockable electrical connectors prevents insertion, and in other cases the limited space envelope in proximity to the connector prevents access to the release control at such time as it may be required to remove the connector.

Typically, the reduction of space envelope around a connector, when in situation connected to a mating plug or socket of electrical equipment, is confined to a region which extends away from the equipment by a distance no greater than the length of the connector. Accordingly, it should be possible to overcome the problem arising from the reduced space envelope by providing connectors having a longer length body. Thus, the release control may then be spaced further from the interface end of the connector, at a position clear of, for example, any metallic tabs or handles. However, that solution suffers the disadvantage that it would substantially negate the space reduction advantage which the more compactly designed equipment seeks to achieve. That is because a greater space would be required between the equipment and the wall or other surface in front of which the equipment is positioned in order to accommodate the longer connector.

China patent CN 202949090U discloses a locking electrical connector, comprising a main body having a first end region which comprises one or more electrical contacts in use for contact with a complementary connector component. The main body further has a second end region opposite to said first end region and from which depends a protective guide through which a flexible conductor may extend. Said main body of the connector comprises a locking mechanism, in use, the connector may be selectively releasably secured to a complementary connector component, and the connector comprises a release control operable to act on the locking mechanism and allow release of the connector from the complementary connector component. Said release control is operable at a position further from the first end of the connector than said second end as considered in the direction of the length of the connector.

Although the patented product described above avoids the problem of interference with other components to some extent, it still has the following disadvantages: locking tab is large in hardness, easy to scratch the plug and drop copper scraps. Therefore, it is recommended that the user first unlocks the locking tab, then inserts the plug, and then releases the locking tab. In this way, such a method can protect the plug from scratching. However, in the existing pull ring product form, it is not convenient to operate the pull ring to release the locking tab at the same time when the plug is inserted, which does not conform to operating habits of users.

Embodiment I

As shown, a self-locking plug includes a main body 1, a plug terminal contact seat 2 arranged in the main body and at least one plug terminal contact 20 being securely arranged thereon, at least one locking tab 3, and a linkage 4. The self-locking plug further includes a key mechanism 5 arranged in the main body 1. The key mechanism 5 includes a pressing portion 52 and a driving portion 54 which are respectively arranged at two ends of the key mechanism 5. The driving portion 54 is associated with one end of the linkage 4, and is configured to drive the linkage 4 to reciprocate in an axial direction of the main body 1 to switch the locking tab 3 between a releasing state and a locking state. It should be noted that, in the present application, the plug insertion end is a head end or a front end, and the connection end with the power line is a tail end or a rear end. This definition is for ease of description only and does not constitute any limitation on the scope of protection.

In general, three plug terminal contacts with types such as C14 and C13 are arranged in the main body, and meanwhile, a locking tab is arranged correspondingly. While the present application also applies to the cases of one or two or more plug terminal contacts, besides, in terms of the locking tab, two or more locking tabs can be driven simultaneously by a key mechanism through a linkage, which can be easily achieved based on design concepts of the present application, for example, three plug terminal contacts cooperate with one locking tab, three plug terminal contacts cooperate with two locking tabs, two plug terminal contacts cooperate with one locking tab, two plug terminal contacts cooperate with two locking tabs, one plug terminal contact cooperates with one locking tab, and the like. The present application is described by taking cooperation of three plug terminal contacts and one locking tab as an example. Positions and functions of the locking tab are similar to the prior art, and will not be described here in detail.

In the self-locking plug of the present application, pressing on the key mechanism 5 is converted to driving on the locking tab 3 through the linkage 4, and the key mechanism 5 itself is of a lever-type structure, the rotation of the key mechanism 5 around a shaft when a force is applied on the pressing portion 52 thereof results in a plugging or unplugging action of the self-locking plug. In operation, it is only necessary to hold the pressing portion 52 and apply a force to ensure that the locking tab 3 is in a releasing state whether the plug is inserted or unplugged, which avoids abrasion of the locking tab 3 against the plug, and improves safety in use and service life, besides, the key mechanism has a small range of action and little interference with the surrounding parts, thereby is applicable for any compact operation space.

A return spring is arranged between the key mechanism and the main body, so that the linkage protrudes forward to maintain the locking tab in the locking state, namely, the locking tab is biased towards the locking direction. Of course, a return spring can also be arranged between the linkage and the main body or between the linkage and the plug terminal contact. The return spring on the key mechanism can take various forms such as a torsional spring, and of course, return springs can be arranged between the key mechanism and the main body and between the linkage and the main body or the plug terminal contact simultaneously, so as to ensure the locking tab is effectively locked.

The main body 1 includes a bottom shell and an upper cover 12 that are fixedly connected with each other. The bottom shell 11 includes a bottom plate 13, a head cavity 10 integrally arranged at a front end of the bottom plate 13 and a cable exiting groove 14 integrally arranged at a tail end of the bottom plate 13. A front end of the plug terminal contact seat extends into the head cavity, and a rear end of the plug terminal contact seat is limited by a positioning boss 15 arranged on the bottom plate, and meanwhile, a plurality of engagement bosses 19 are arranged on a bottom surface of the plug terminal contact seat to fit into corresponding engagement holes in the bottom plate for fixing the plug terminal contact seat. A front end of the upper cover 12 is arranged with a lip 121 that can be fitted into the head cavity. A guide plate 101 is arranged in the head cavity, and a corresponding guide notch is arranged in the lip. The lip design guarantees an insertion depth and achieves connection stability and a sealing effect. The matching arrangement of the guide notch and the guide plate enhances the connection strength, and the arrangement of the guide plate also enhances the strength of the cavity on the bottom shell.

A guide groove 21 is formed at a bottom portion of the plug terminal contact seat and is configured to position and guide the linkage. A spring positioning boss 22 is arranged in the guide groove. A spring-embedded groove 41 with an opening at a rear end is arranged in the linkage 4 for positioning a return spring 40. The spring-embedded groove and the guide groove form an accommodation space of the return spring.

Meanwhile, a locking tab positioning groove is formed at the front end of the plug terminal contact seat. The locking tab positioning groove and a locking tab positioning boss in the head cavity cooperate to position an upper end of the locking tab. An embedding groove for positioning and linking the lower end of the locking tab is arranged at the front end of the linkage. A longitudinal direction of a locking hole formed on the locking tab is perpendicular to the linkage, as such, locking on a non-contact side of the plug is achieved, to avoid deformation of the plug, besides, the locking effect is improved by means of a rough surface on the non-contact side.

The bottom shell extends in the whole plug direction, and constitutes a closed cavity with the aid of fixed connection of the upper cover, which is good in integrity and convenient for installation. The arrangement of the head cavity and the rear positioning boss facilitates the assembly, furthermore, arrangement of a return spring and guiding of the linkage by a plug terminal contact seat improve space utilization. The spring is defined in a relatively closed cavity, which improves stability, and has high overall insulation effect.

Embodiment II

Specifically, for ease of operation, the key mechanism is two in number, two key mechanisms are arranged symmetrically, and preferably, a tail portion of the linkage is in drive-connection with the two key mechanisms simultaneously. The synchronous operation of the two key mechanisms uniformly applies force to the linkage, thereby ensuring a smooth axial movement thereof, and achieving a smooth switching between states of the locking tab. Tail ends of the bottom shell and the upper cover are respectively formed with holes, and two ends of the rotary shaft of the key mechanism are fitted into the holes and thus are clamped and positioned. Through this kind of clamping and positioning, the key mechanism cannot fall off, and the assembly is simple.

In order to achieve the drive-connection, a driving pin is arranged on the driving portion 54, and a sliding groove 45 is arranged at the tail portion of the linkage 4. Alternatively, a sliding groove 45 is arranged on the driving portion 54, and a driving pin is correspondingly arranged at the tail portion of the linkage 4. It should be noted that, in order to achieve conversion between rotation and translation, the sliding groove 45 is designed to be in an arc shape, and an axial translation driving of the key mechanism with respect to the linkage 4 can be realized through relative movement of the driving pin in the sliding groove 45.

In order to improve the integrity and reduce the overall size, the key mechanism 5 is of a groove-type structure with side portions of the main body being fitted therein. The sliding groove 45 or the driving pin is correspondingly arranged on an inner sidewall of the driving portion 54, and escape recesses are arranged on the main body corresponding to the driving portion 54 and a linkage portion. That is, the longitudinal section of the key mechanism 5 is of a U-shaped or C-shaped structure, meanwhile, a corresponding snap-in structure is arranged on the main body, for achieving effective limiting and guiding at the same time of movably escaping the key mechanism. Moreover, a snap-fit connection, namely an engagement mechanism, can also be arranged between the driving portion 54 of the key mechanism 5 and the main body 1, and between the pressing portion 52 of the key mechanism 5 and the main body 1, such that locking can be maintained in a position state, and in some situations, the plug can firstly be kept in a releasing state of the locking tab through locking of the pressed pressing portion 52 and the main body, and then is switched to a locking state of the locking tab after being inserted. It is completely unnecessary to press the pressing portion 52 upon insertion. States of the key mechanism are switched by hand or a tool after insertion, so as to further carry out the installation in a harsh environment, besides, dual locking resulting from the locking spring and engagement between key and the main body further improves the locking effect. Meanwhile, in order to improve the operation feeling, a plurality of convex edges or convex points is arranged on the contact surface of the pressing portion 52 to increase friction.

A middle portion of the key mechanism is axially connected with the main body, the driving portion 54 and the pressing portion 52 are arranged at an angle, which is preferably a right angle, or any other suitable angle, alternatively, the driving portion 54 and the pressing portion 52 are arranged linearly.

As one of the preferred embodiments, the two key mechanisms 5 are symmetrically arranged at a tail portion of the main body 12 and located at both sides in a width direction. A rectangular groove 51 is formed on the inner sidewall of the driving portion 54. A rectangular ejector pin 42 perpendicularly to the tail portion of linkage is formed to be fitted into the rectangular groove 51. A tail end face of the ejector pin 42 is formed with an arc chamfer, which achieves catching of the ejector pin 42 in the rectangular groove 51 and guarantees the overall linkage effect. A design similar to a dead point is formed after the arc chamfer. The ejector pin 42 is completely in the rectangular groove 51 in a free state. In this case, the locking tab 3 maintains the maximum inclined state. When the locking tab 3 needs to be inserted, the key mechanism 5 is pressed to make the locking tab 3 in an upright state, i.e., a releasing state. When the key mechanism 3 is released, the return spring 40 urges the key mechanism to reset and lock the locking tab 3 and the plug. In this case, the arc chamfered end of the ejector pin 42 is in integral contact with the rectangular groove 51. The abutting contact guarantees the stability of the key mechanism and the linkage. Moreover, the key mechanism is arranged at the tail portion of the plug, which avoids interference with other structures.

Embodiment III

In order to achieve a smooth axial reciprocating movement of the linkage relative to the main body, a recessed groove 18 with openings respectively at a front end and a tail end thereof is formed at a tail portion of the bottom plate. A raised guide portion 43 (such as a hollow annular guide portion) mated with the recessed groove is formed on the linkage, and the guide portion is flush with or is lower than a bottom surface of the bottom plate. This enables a bottom surface of the plug to be designed as a flat surface, which satisfies the plug-in requirements of different situations and reduces interference with other components. The head section of the linkage extends into the inner cavity of the main body and is in linkage with the locking tab, and the tail end of the linkage is designed to be exposed and guided by the recessed groove, therefore, the overall size and the overall appearance are not changed, and the linkage can be suitable for various existing application occasions.

Further, in order to improve constraints on the tail portion of the linkage, at least an end portion of the recessed groove is a T-shaped groove, and the linkage forms a guide fin 44 corresponding to T-shaped groove. The guide fin extending laterally at the tail portion of the linkage cooperates with the T-shaped groove, to prevent the tail end of the linkage from raising upwards, and guarantee effective and smooth transmission of the key mechanism and the linkage.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A self-locking plug, comprising a main body, a plug terminal contact seat arranged in the main body for positioning a plug terminal contact, at least one locking tab, and a linkage, wherein the self-locking plug further comprises two key mechanisms arranged in the main body, wherein each of the two key mechanisms comprises a pressing portion and a driving portion which are respectively arranged at two ends of each of the two key mechanisms, and wherein the driving portion is associated with one end of the linkage, and is configured to drive the linkage to reciprocate in an axial direction of the main body to switch the locking tab between a releasing state and a locking state, wherein the linkage is in drive-connection with the two key mechanisms.

2. The self-locking plug according to claim 1, wherein the two key mechanisms are arranged symmetrically.

3. The self-locking plug according to claim 1, wherein a sliding groove is arranged on the linkage, a driving pin is correspondingly arranged on the driving portion, or a driving pin is arranged on the linkage, and a sliding groove is correspondingly arranged on the driving portion.

4. The self-locking plug according to claim 3, wherein the driving pin is an ejector pin arranged on both sides of a tail end of the linkage, a tail end face of the ejector pin is formed with an arc chamfer, and the sliding groove is a rectangular groove.

5. The self-locking plug according to claim 1, wherein:

the main body comprises a bottom shell and an upper cover that are fixedly connected with each other, the bottom shell comprises a bottom plate, a head cavity integrally arranged at a front end of the bottom plate and a cable exiting groove integrally arranged at a tail end of the bottom plate, and a front end of the plug terminal contact seat extends into the head cavity, and a rear end of the plug terminal contact seat is limited by a positioning boss arranged on the bottom plate.

6. The self-locking plug according to claim 5, wherein:

a guide groove is formed at a bottom portion of the plug terminal contact seat and is configured to position and guide the linkage, a spring positioning boss is arranged in the guide groove, and a spring-embedded groove with an opening at a rear end is arranged on the linkage for positioning a return spring.

7. The self-locking plug according to claim 3, wherein each of the key mechanisms is of a groove-type structure with side portions of the main body fitted therein, the sliding groove or the driving pin is correspondingly arranged on an inner sidewall of the driving portion, and escape recesses are arranged on the main body corresponding to the driving portion and a linkage portion.

8. The self-locking plug according to claim 6, wherein a recessed groove with an opening at a tail end thereof is formed at a tail portion of the bottom plate, and a tail end of the linkage extends out of the main body and is fitted in the recessed groove.

9. The self-locking plug according to claim 8, wherein a raised guide portion mated with the recessed groove is formed on the linkage, and the guide portion is flush with or is lower than a bottom surface of the bottom plate.

10. The self-locking plug according to claim 9, wherein at least an end portion of the recessed groove is a T-shaped groove, and the linkage is formed with a guide fin corresponding to the T-shaped groove.

* * * * *